US005094509A

United States Patent [19]

Bolzacchini

[11] Patent Number: 5,094,509

[45] Date of Patent: Mar. 10, 1992

[54] DECK CHAIR TO TRANSFORM INTO A SUN BED

[76] Inventor: Maurizio Bolzacchini, Via Don Mazzolari 8, Carpenedolo (Brescia), Italy

[21] Appl. No.: 575,308

[22] Filed: Aug. 29, 1990

[51] Int. Cl.[5] ..... B60N 1/02

[52] U.S. Cl. ..... 297/377; 297/23

[58] Field of Search ..... 297/377, 16, 23, 31, 297/52, 56

[56] References Cited

U.S. PATENT DOCUMENTS 2,006,823 7/1935 Beeskow ..... 297/23
2,660,224 11/1953 Frisch ..... 297/23
2,735,479 2/1956 Bugg ..... 297/23

FOREIGN PATENT DOCUMENTS 141423 7/1953 Sweden ..... 297/23
340093 12/1930 United Kingdom ..... 297/23
658924 10/1951 United Kingdom ..... 297/23

*Primary Examiner*—Laurie K. Cranmer
*Attorney, Agent, or Firm*—McGlew & Tuttle

[57] ABSTRACT

A deck chair comprising a cloth (20) and a frame (10–13) consisting of a number of components to be arranged in two different ways so as to obtain either a real deck chair with an inclined and adjustable seat or a sun bed with a substantially flat canvas to lie on.

11 Claims, 3 Drawing Sheets

DECK CHAIR TO TRANSFORM INTO A SUN BED

FIELD OF THE INVENTION

The present invention is directed to a deck chair with a seat made of cloth and in particular to a deck chair structured in such a way that it may be transformed into a sun bed and vice versa.

BACKGROUND OF THE INVENTION

Standard type deck chairs and sun beds are made for a single use only, that is to say that they cannot be used to a purpose which is different from that for which they have been designed. In fact their specific structure, even if it allows some adjustments of their position and their folding to store them up, does not allow to change their basic design. A deck chair, however is is adjusted, is always a deck chair and nothing else and a sun bed can only be used as such.

SUMMARY AND OBJECT OF THE INVENTION

It is instead the object of the present invention to propose a special deck chair structured in such a way that is may easily be transformed into a sun bed and vice versa.

Another object of the invention is to propose a structure for a seat to be used for two different purposes: as a normal deck chair and also as a sun bed, just by means of a few and easy operations and without disassembling it.

A further object of the invention is to assemble into a single unit all the elements required for a selective use of a deck chair and of a sun bed, i.e. of two different items which so far are only available as two different structures, each one designed for its specific utilization.

According to the invention, a deck chair structure is provided including a first side member and a second side member. The first side member and the second side member are connected by at least one top crossbar and by at least one bottom crossbar to form a substantially rigid side member substructure. A first notched supporting member and a second notched supporting member are provided, linked to each other by at least one rear crossbar and at least one front crossbar to form a substantially rigid notched supporting member substructure. The notched supporting member substructure is pivotably connected to the side members for pivoting the notched supporting member substructure into the plane of the side member substructure and out of the plane of the side member substructure. A cloth element is provided fixed to the front crossbar of the notched supporting member substructure and fixed to the top crossbar of the side member substructure. A first main leg and a second main leg are provided with ends pivotably connected to the first side member and second side member, respectively. The first main leg and the second main leg each include another end connected to a crossbar connecting the first main leg and the second main leg to form a main leg substructure which may be pivoted into and pivoted out of the plane of the side member substructure. The crossbar is selectively engageable with pairs of notches on the first and second supporting members when each of the supporting member substructure and main leg substructure is pivoted out of the plane of the side member substructure. Horizontal positioning means are provided for maintaining the side member substructure and the supporting member substructure in a horizontal position and stretching a cloth for use of the deck chair as a sun bed. This horizontal positioning means includes first and second rafters which are pivotably connected to the supporting member substructure and moveable into and out of a plane with the supporting member substructure, each of the rafters having a second end spaced from the pivot location which is engageable with the crossbar of the main leg substructure. Auxiliary legs are provided, pivotably connected to one of the side member substructure and supporting member substructure and moveable into and out of the plane of the side member substructure and supporting member substructure and into a position for supporting the side member substructure and supporting member substructure in a horizontal position by engaging a stop member connected to one of the side member substructure and supporting member substructure to fix the position of the auxiliary legs with respect to the side member substructure and supporting member substructure.

BRIEF DESCRIPTION OF THE DRAWINGS

Further details are evidenced in the following description with reference to the enclosed drawing showing an embodiment of the invention which is a non-limitating example of the relevant structure. In said drawing.

DESCRIPTION OF THE PREFERRED EMBODIMENT

Figure 2:
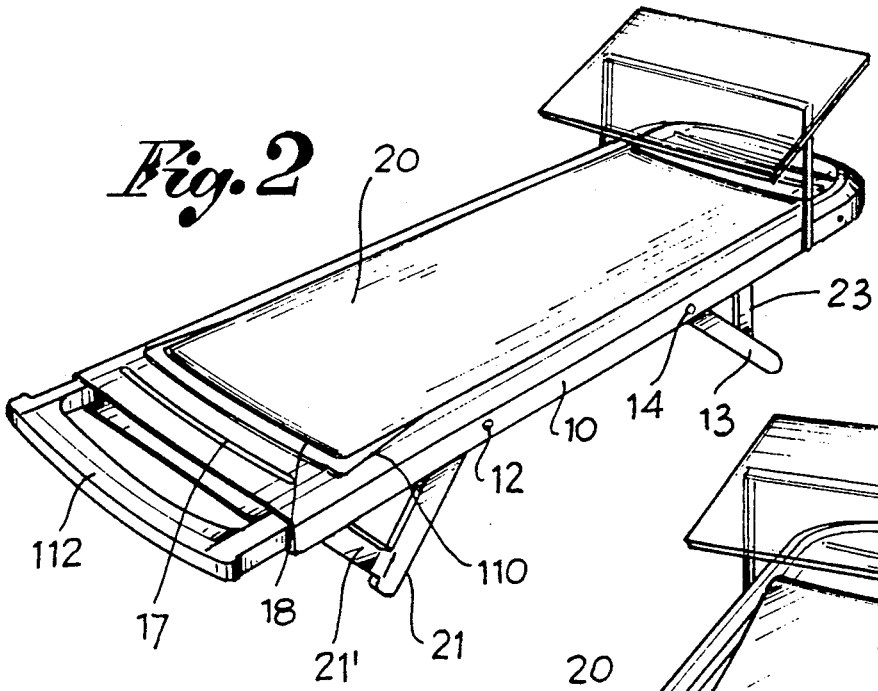
FIG. 2 shows a perspective view of the same item in it position as a sun bed.

The structure here in question comprises a frame made of two side members 10 with an adjustable inclination and a couple of supporting members 11 pivoted at pivot 12 on side members 10 which may be either inclined with different angles or coplanar in respect to said side members 10, two first legs 13 pivoted at pivot 14 on side members 10 and supporting a cross bar 15 to be selectively fitted into positioning notches 11' on supporting members 11.

Figure 4:
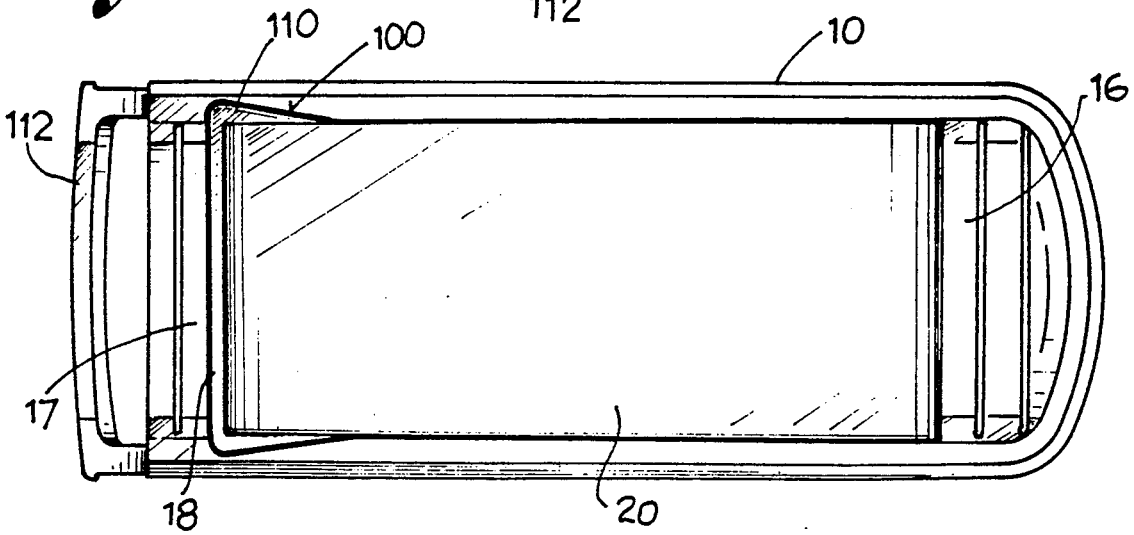
FIG. 4 shows a top view of the sun bed.

Side members 10 are connected to each other by at least one top or rear bar 16 and a bottom bar 17, while supporting members 11 are connected by at least one top front bar 18 and by a panel 19 which is preferably curved with a concave top surface. To top cross bars 16, 18 of side members 10 and supporting members 11 respectively the ends of a canvas or cloth 20 are removably fixed, said cloth forming a concave seat when side and supporting members are x-wise open, while it will be stretched on panel 19 when said side and supporting members 10, 11 are closed, coplanar and adjacent. To assure a uniform width of the whole cloth, the front top side of members 11 is enlarged in correspondence to notches 100 inside side members 10, as shown in FIGS. 2 and 4.

Figure 3:
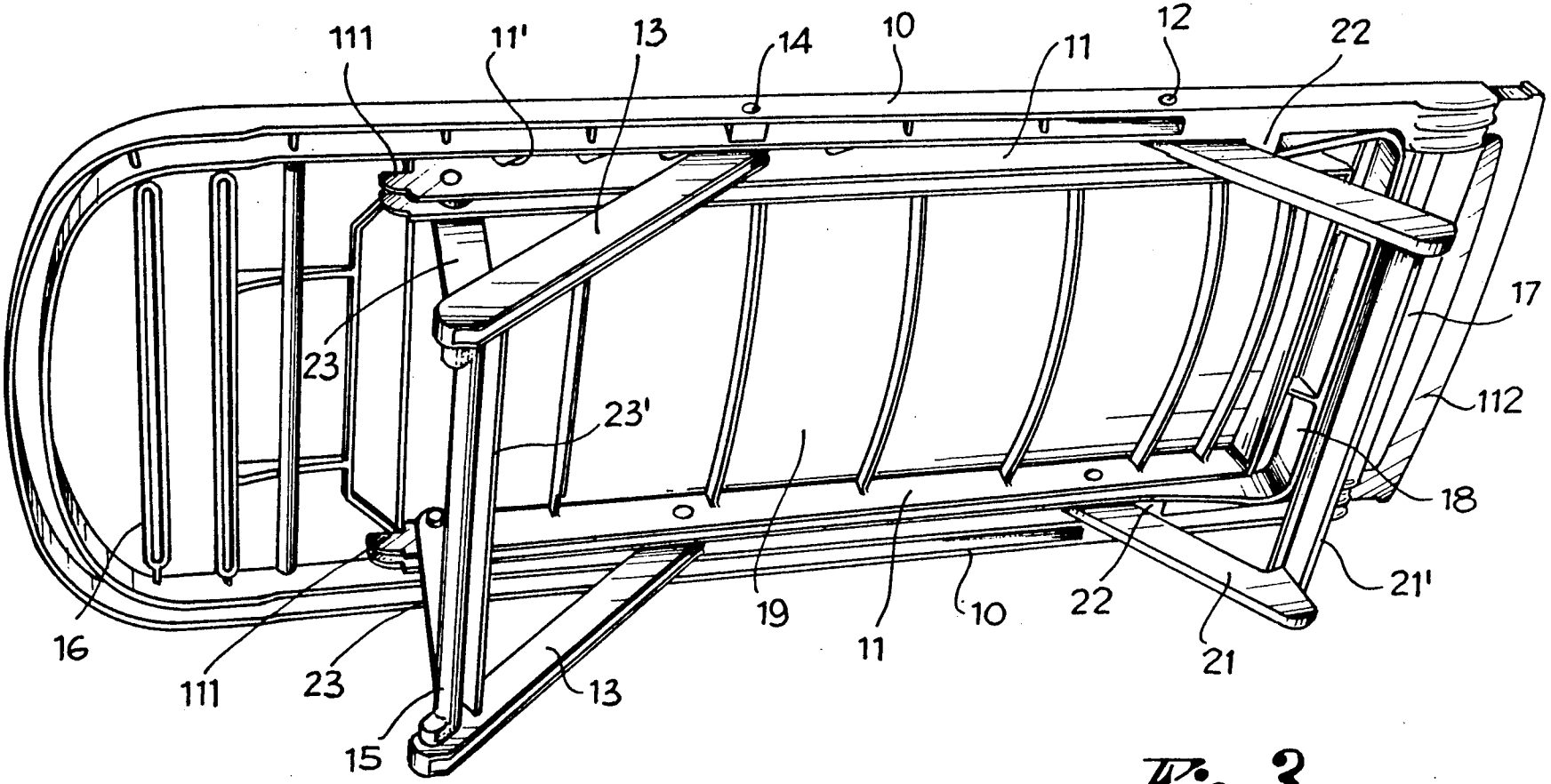
FIG. 3 shows a bottom view of the structure shown in FIG. 1.

The frame further comprises two auxiliary legs 21 pivoted on side members 10, e.g. at pivot 12 like supporting members 11 and movable from a passive position, where they are coplanar and folded along supporting member 11, to an active position where they rest on the floor and are kept in this position by stops 22 on side members 10 (see FIG. 3). For their simultaneous displacement from one position into the other one the auxiliary legs 21 are connected by a cross member 21'.

On the bottom rear end of supporting members 11 locking rafters 23 connected by a cross bar 23' are pivoted to allow their simultaneous motion from a passive position where they are folded along supporting members 11 to an active position where they engage the cross members 15' of the first legs 15.

To manufacture the above described structure, exception made for the canvas or cloth, any suitable material usually employed to make furniture may be used and preferably one of the synthetic materials used to make garden furniture.

In particular, the supporting members 11 shall extend rearwards to a length allowing them a free passage between legs 13 inside cross bar 15. On the other hand, the length of said members 11 shall be such that their ends 111 rest below top cross bar 16 of side members 10 when they are coplanar and adjacent (see FIG. 3). In addition, the section of each component shall be suitably dimensioned to ensure the necessary robustness, and in particular, while side members 10, supporting members and legs 13 shall have a C-section, the section of the auxiliary legs 15 shall be tubular and with or without a reinforcement inside. Instead of letting members 11 rest on 111, a stop 24 may be provided on which legs 13 (see FIG. 6) shall rest when the structured is used as a sun bed.

Figure 1:
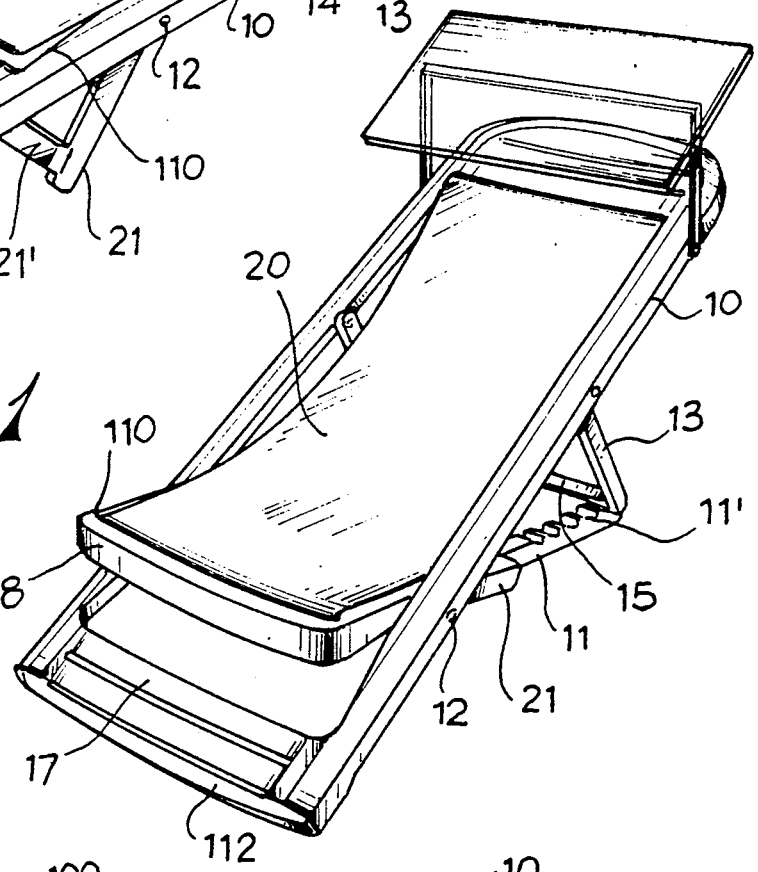
FIG. 1 shows a perspective view of the item in its position as a deck chair.

When auxiliary legs 21 and rafters 23 are folded into a passive position along members 11, the structure is ready to be used as a deck chair as shown in FIG. 1. In this position side members 10 and supporting members 11 are open x-wise and the first two legs 13 engage, by means of their cross bar 15, the positioning notches 11'. Thus canvas 20 forms a concave seat and by changing the position of cross bar 15 in notches 11' the inclination of the side members can be adjusted to bring the seat into its most comfortable position.

Figure 6:
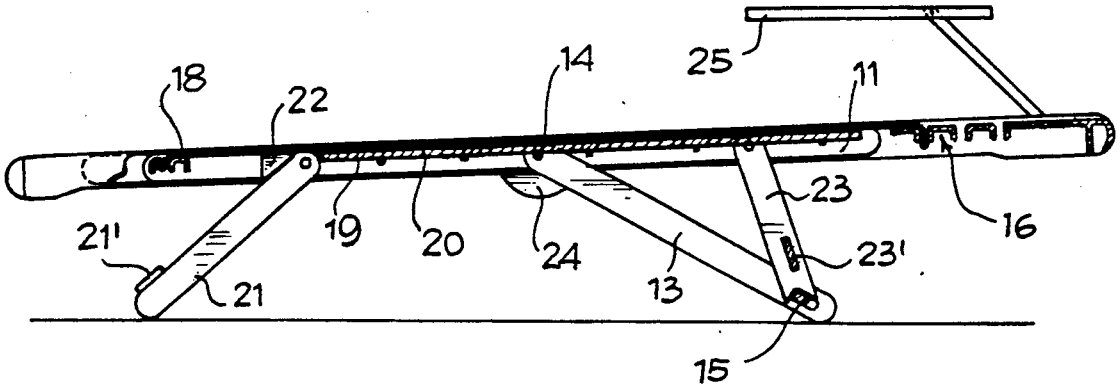
FIG. 6 shows a sectioned side view of the sun bed.
Figure 5:
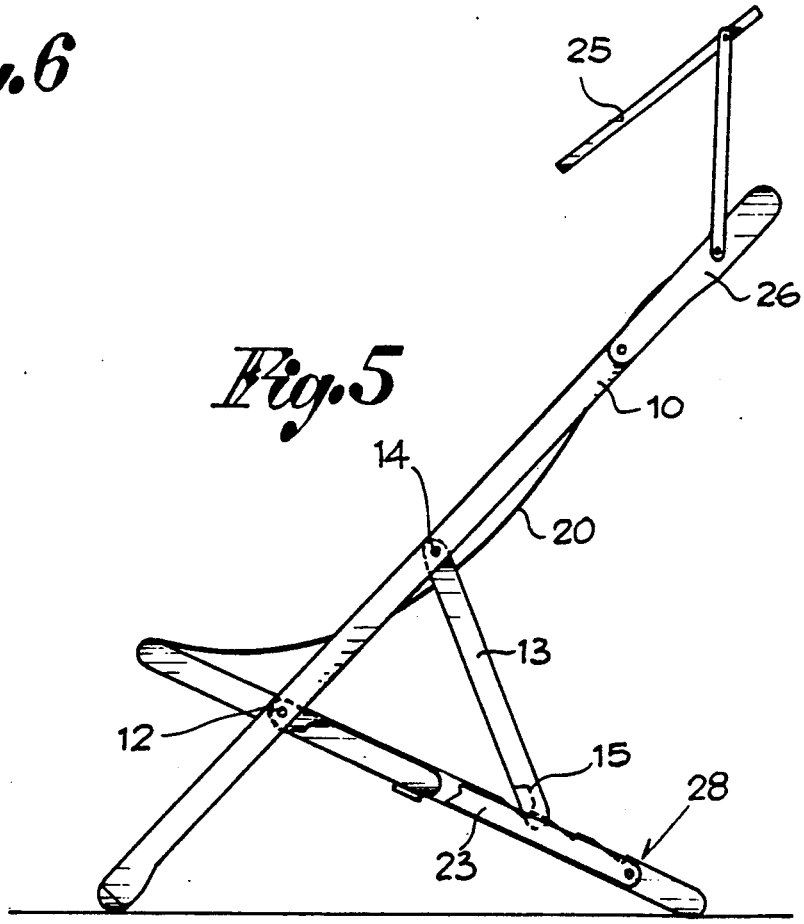
FIG. 5 shows a partially sectioned side view of the deck chair in FIG. 1.

The same structure may also be used as a sun bed as shown in FIGS. 2, 4 and 6. In this case side members 10 and supporting members 11 shall be taken into a coplanar position, while the first two legs 13 and also the auxiliary legs 21 are taken into an angular position towards side members 10, so as to rest on the floor and support the frame in its horizontal position. In particular, legs 21 shall rest against stops 22, while the pair of legs 13 is locked by rafters 23 and eventually against stops 24, the ends 111 of supporting members 11 resting below the top cross bar of side members 10 to correctly support the latter too. In these conditions the cloth 20 is longitudinally spread out and substantially stretched within an anatomic plane 19 to support the person lying on the bed.

The above described structure may be advantageously fitted with an extension 112 to be extractably inserted into the front or foot ends of the side members and to be used as a foot rest. In addition, a sun shed 25 may be suitably fitted to the head end of the sun bed. The side members themselves may be split to obtain a linked and adjustable head rest 26.

To transform the structure from deck chair into sun bed supporting members 11 on one side and a pair of auxiliary legs 21 on the other side shall be used as bearing elements. In order to take side members 10 into their horizontal position as required for a sun bed, the ends of the two legs 13 shall engage ends 28 of supporting members 11 and then the cloth 20 is fastened into its stretched position by fixing it on side members 10 with suitable means.

I claim:

1. A deck chair structure, comprising:

a side member substructure including a first side member and a second side member connected by a top crossbar and a bottom crossbar;

a notched supporting member substructure including a first notched supporting member and a second notched supporting member connected by a front crossbar and a rear crossbar, said notched supporting member substructure being positioned within said side member substructure, pivotably connected to each of said first side member and second side member along a pivot axis for moving said notched supporting member substructure into a plane of said side member substructure and out of the plane of said side member substructure;

a cloth element having a first end connected to said front crossbar of said supporting member substructure and having a second end connected to said top crossbar of said side member substructure;

a main leg substructure including a first main leg pivotably connected to said first side member and a second main leg pivotably connected to said second side member, each of said first main leg and said second main leg having an end opposite said first end connected to a crossbar, said main leg substructure being pivotable into the plane of the side member substructure and being pivotable out of the plane of said member substructure; and horizontal support means for maintaining said supporting member substructure in a plane of said side member support structure and for maintaining said member support substructure in a substantially horizontal position and stretching said cloth between said front cross member and said upper cross member for supporting said cloth in said substantially horizontal position.

2. The desk chair structure according to claim 1, wherein said horizontal support means includes a pair of auxiliary legs pivotably connected to said side members at a location spaced from said main leg substructure, said auxiliary legs engaging a stop member provided on said side member substructure.

3. A deck chair structure according to claim 2, wherein said main leg substructure is locked against pivotable movement by engaging a stop provided on said supporting member substructure, said horizontal support means further comprising rafters pivotably connected to said supporting member substructure, said rafters being pivotable into and out of the plane of said supporting member substructure, and including a notched end engageable with said crossbar of said main leg substructure.

4. A deck chair structure according to claim 1, wherein said supporting member substructure is moveable out of said plane of said side member substructure, said supporting member substructure including ends positionable adjacent to the side members spaced from said top crossbar and maintained in the plane of said side member substructure by rafter elements, said rafter elements being pivotably connected to said supporting member substructure and including endsengageable with said crossbar of said main leg substructure, auxiliary legs being provided pivotably connected to said side member substructure and engaging a stop provided on said side member substructure to support said side member substructure by one end by said auxiliary legs.

5. A deck chair structure according to claim 1, wherein said supporting member substructure further comprises concave-shaped crossbars connecting said first side element and said second side element and supporting said stretched cloth in said substantially horizontal position.

6. A deck chair structure according to claim 1, wherein said supporting member substructure further comprises a substantially concave panel having a first end connected to said first side member and having a second end connected to said second side member to support said stretched cloth in said substantially horizontal position.

7. A deck chair structure according to claim 1, further comprising an extractable extension element inserted into a bottom end of said side members for providing an extension to said side member substructure.

8. A deck chair structure according to claim 1, wherein said supporting member substructure front crossbar includes an enlarged width region, said side member substructure defining a recess for receiving said enlarged width region when said supporting member substructure is pivoted into the plane of said side member substructure.

9. A deck chair structure according to claim 1, wherein said horizontal support means includes an auxiliary leg substructure including a first auxiliary leg pivotably connected to said first side member, a second auxiliary leg pivotably connected to said second side member, said first auxiliary leg and said second auxiliary leg being pivotable to engage a stop formed on said side member substructure.

10. A deck chair structure according to claim 1, wherein each of said first side member and said second side member are made of two pieces, including a piece providing a linked and adjustable headrest.

11. A deck chair structure, comprising:

a side member substructure including a first side member and a second side member connected by a top crossbar and a bottom crossbar;

a notched supporting member substructure including a first notched supporting member and a second notched supporting member connected by a front crossbar and a rear crossbar, said notched supporting member substructure being positioned within said side member substructure, pivotably connected to each of said first side member and second side member along a pivot axis for moving said notched supporting member substructure into a plane of said side member substructure and out of the plane of said side member substructure;

a cloth element having a first end connected to said front crossbar of said supporting member substructure and having a second end connected to said top crossbar of said side member substructure;

a main leg substructure including a first main leg pivotably connected to said first side member and a second main leg pivotably connected to said second side member, each of said first main leg and said second main leg having an end opposite said first end connected to a crossbar, said main leg substructure being pivotable into the plane of the side member substructure and being pivotable out of the plane of said member substructure;

an auxiliary leg substructure including a first auxiliary leg pivotably connected to said fiirst side member and a second auxiliary leg pivotably connected to said second side member and an auxiliary cross member for connecting each of said first auxiliary leg and said second auxiliary leg;

a stop element connected to said side member support structure, said auxiliary leg support structure being pivotable to engage said stop member for fixing the position of said auxiliary leg substructure with respect to said side member substructure; and a rafter substructure including a first rafter pivotably connected to said first supporting member and a second rafter member pivotably connected to said second supporting member and a cross member connecting said first rafter member and said second rafter member, each of said first rafter member and said second rafter member including a notched end engageable with said main leg substructure crossbar whereby said supporting member substructure is moveable out of the plane of said side member substructure and said main leg substructure is moveable for engaging said main leg crossbar with notches of said supporting member substructure to fix the deck chair structure in one of a plurality of deck chair positions, and wherein said supporting member substructure is moveable into the plane of said side member substructure, said rafter substructure notched portions engaging said main leg crossbar and said auxiliary leg substructure engaging said stop to maintain said side member substructure and said supporting member substructure in a substantially horizontal position and stretch said cloth between said upper cross member and said front cross member to support said cloth in a substantially horizontal position.

* * * * *